US012781572B2

(12) United States Patent
Zahir Sulaiman Al-Shukaili

(10) Patent No.: US 12,781,572 B2
(45) Date of Patent: Nov. 3, 2026

(54) APPARATUS FOR GENERATING AN ULTRA-HIGH PRESSURE FLUID JET DURING DRILLING

(71) Applicant: Yahya Zahir Sulaiman Al-Shukaili, Muscat (OM)

(72) Inventor: Yahya Zahir Sulaiman Al-Shukaili, Muscat (OM)

( * ) Notice: Subject to any disclaimer, the term of this patent is extended or adjusted under 35 U.S.C. 154(b) by 0 days.

(21) Appl. No.: 18/028,241

(22) PCT Filed: Oct. 11, 2022

(86) PCT No.: PCT/IB2022/059722
§ 371 (c)(1),
(2) Date: Mar. 24, 2023

(87) PCT Pub. No.: WO2024/079503
PCT Pub. Date: Apr. 18, 2024

(65) Prior Publication Data
US 2025/0237111 A1 Jul. 24, 2025

(51) Int. Cl.
*E21B 7/18* (2006.01)

(52) U.S. Cl.
CPC ..... *E21B 7/18* (2013.01)

(58) Field of Classification Search
CPC ..... E21B 7/18
See application file for complete search history.

(56) References Cited

U.S. PATENT DOCUMENTS

| | | | | |
|---|---|---|---|---|
| 3,565,191 A * | 2/1971 | Bowen | E21B 7/18 175/207 |
| 4,458,766 A * | 7/1984 | Siegel | E21B 7/18 175/25 |
| 6,289,998 B1 * | 9/2001 | Krueger | E21B 7/18 175/25 |
| 11,401,792 B2 * | 8/2022 | Mollatt | F04B 9/00 |

* cited by examiner

*Primary Examiner* — Tara Schimpf
*Assistant Examiner* — Daniel T Craig
(74) *Attorney, Agent, or Firm* — Sughrue Mion, PLLC

(57) ABSTRACT

An apparatus for generating an ultra-high pressure fluid jet during drilling comprises a drilling motor; a housing structure connected with the drilling motor; and a drill bit assembly connected at the downstream end of the housing structure. The housing structure comprises an oscillation tool configured to transfer a pressure energy from pumped drilling fluid to a closed loop hydraulic circuit and pressurize the same therein; a pressure intensifier pump configured to increase hydraulic pressure of closed loop hydraulic fluid to an ultra-high pressure; and a pressure transfer tool configured to transfer the ultra-high pressure from the closed loop hydraulic fluid to the low-pressure drilling fluid, without any communication between the drilling fluid and closed loop hydraulic fluid and without requiring the drilling fluid to enter pressure intensifier pump. The ultra-high pressure of drilling fluid is directed to the drill bit assembly to aid drilling efficiency in drilling applications.

10 Claims, 10 Drawing Sheets

APPARATUS FOR GENERATING AN ULTRA-HIGH PRESSURE FLUID JET DURING DRILLING

CROSS REFERENCE TO RELATED APPLICATIONS

This application is a National Stage of International Application No. PCT/IB2022/059722 filed Oct. 11, 2022.

FIELD OF THE INVENTION

This present invention relates generally to drilling wellbores apparatus and more particularly to an apparatus for generating an ultra-high pressure fluid jet during drilling to aid drilling efficiency in drilling applications.

BACKGROUND OF THE INVENTION

In the drilling of deep holes, such as in drilling oil and gas wells, rate of penetration (ROP) slows in deep formation of gas and oil wells where the rocks become harder and more difficult to drill. For drilling rocks, a jet of high-pressure fluid is used to assist the drilling operation and enhance rate of penetration (ROP). The supply of the high pressure can be done either directly from the surface, or using downhole intensifier pumps. The supply of high pressure from surface are expensive and unreliable. Therefore, they have not gained a commercial acceptance.

The supply of high pressure using downhole intensifier pump has different concepts and different approaches. For example: two of those have been disclosed in US patent application numbers 6,289,998 and 5,787,998. Some of these intensifier pumps have been developed and tested in fields, and have demonstrated that ultra-high pressure can be generated down hole using the intensifier pump. However, the reliability of downhole intensifier pump and pump life need to be improved further to have commercial acceptance.

Herein, the reliability concern is mainly due to erosion and particle abrasion caused by drilling fluid inside the intensifier pump, which eventually leads to pump's failures. Additionally, to reduce the effect of fluid particles, these pumps have their own limitations to drill with high drilling fluid weight. Consequently, this restricts their usage/application in deep wells which normally need high drilling fluid weight. Besides the above problems, it has been observed that if a motor is being utilized in the drilling assembly, then the additional rotation of motor is never delivered to drill bit due to the inherent design of the pumps, which takes away the advantage of higher bit rotation attempted from the motor.

Therefore, there is a need in the art for an apparatus for generating an ultra-high pressure fluid jet during drilling to aid drilling efficiency in drilling applications. Such apparatus should not suffer from the above-mentioned deficiencies and should be able to generate ultra-high pressure for abrasive drilling fluid without any limit in terms of drilling depth, drilling fluid weight or drilling fluid types.

SUMMARY OF THE INVENTION

According to a first aspect of the present invention, there is provided an apparatus for generating an ultra-high pressure fluid jet during drilling. The apparatus comprises a drilling motor to enable rotation of the apparatus; a housing structure having a longitudinal string axis, an upstream end connected with the drilling motor adapted to receive a drilling fluid therefrom and a downstream end; and a drill bit assembly connected at the downstream end of the housing structure. The drill bit assembly has an ultra high-pressure fluid jet discharge means. Further, the housing structure comprises an oscillation tool configured to transfer a pressure energy from the received drilling fluid to a closed loop hydraulic circuit and pressurize the closed loop hydraulic fluid circulating therein; a pressure intensifier pump connected downstream of the oscillation tool, configured to increase hydraulic pressure of closed loop hydraulic fluid to an ultra-high pressure; and a pressure transfer tool connected downstream of the pressure intensifier pump, configured to transfer the ultra-high pressure from the closed loop hydraulic fluid to the low-pressure drilling fluid, thereby increasing the low-pressure drilling fluid to ultra-high pressure drilling fluid, without any communication between the drilling fluid and closed loop hydraulic fluid and without requiring the drilling fluid to enter pressure intensifier pump; and a hydraulic fluid reservoir, configured to compensate if there is any oil leak in the apparatus. Furthermore, the closed loop hydraulic fluid operates in a closed loop between the oscillation tool, the pressure intensifier pump and the pressure transfer tool without any direct contact with the drilling fluid. Additionally, the ultra-high pressure of drilling fluid is directed to the discharge means in the drill bit assembly to aid drilling efficiency in drilling applications.

It is an advantage of the present invention that the introduction of the closed loop fluid circuit to the apparatus helps to overcome the problems of prior art. It allows the closed loop hydraulic fluid to operate in a closed loop between the oscillation tool, the pressure intensifier pump and the pressure transfer tool without any direct contact with the drilling fluid. This in turn prevents any entry of drilling fluid within the intensifier pumps, thereby posing no harm to the intensifier pump or preventing potential pumps failures and further improving the drilling efficiency. Additionally, it is configured in a way the main objective on providing more and higher bit rotation than drill string is not lost. The present invention can be used for other downhole applications as perforation, fracing and stimulating oil and gas wells or used in drilling underground tunnel or other application having similar problems.

In accordance with an embodiment of the present invention, the drilling applications include drilling of boreholes, perforations, fracing, stimulating oil and gas wells and drilling underground tunnels.

In accordance with an embodiment of the present invention, the apparatus further comprises one or more of drilling fluid circulation paths, and control valves and trigger valves to facilitate the flow of the closed loop hydraulic fluid within the apparatus.

In accordance with an embodiment of the present invention, the oscillation tool is connected with a motor drive shaft and a valve plate assembly. Additionally, the valve plate assembly includes a stationary valve plate fixedly coupled to an upper outer housing and a rotating valve plate mounted and connected with a lower end of the motor drive shaft and rotates with the motor drive shaft. Moreover, the motor drive shaft is configured to rotate the complete downhole apparatus including lower outer housing, or the complete downhole apparatus excluding the lower outer housing, and in case the upper and lower housing are connected together, then the rotation is inside the housing only.

In accordance with an embodiment of the present invention, the oscillation tool comprises, but not limited to, a piston and a plunger disposed in a cylinder having an upper chamber and a lower chamber; a power conduit for enabling a fluid communication between a power port of the rotating valve plate and the upper chamber; a return conduit for enabling a fluid communication between a return valve port of the rotating valve plate and the lower chamber; and an exhaust nozzle provided with the upper chamber and another exhaust nozzle provided with the lower chamber.

In accordance with an embodiment of the present invention, an upward movement of the piston is adapted to displace the drilling fluid from the upper piston chamber through the exhaust nozzle. Further, a downward movement of the piston is adapted to displace the drilling fluid from the lower piston chamber through the another exhaust nozzle. Furthermore, the plunger is adapted to move upward and downwards in the direction of piston movements. Additionally, the downward movement of the plunger is adapted to pressurize the closed loop hydraulic fluid to form a medium pressurized closed loop hydraulic fluid, and the upward movement of the plunger is adapted to draw the closed loop hydraulic fluid to enter the cylinder chamber. Moreover, the medium pressure closed loop hydraulic fluid is directed to the pressure intensifier pump.

In accordance with an embodiment of the present invention, the pressure intensifier pump comprises one or more piston assemblies including one or more intensifier pistons in respective piston chambers, one or more intensifier plungers in respective plunger cylinders, control valve and trigger valve. Besides, the reciprocating motion of the piston assemblies is configured to cause each of the one or more plungers to reciprocate sequentially on an intake stroke, and a discharge stroke to supply the closed loop hydraulic fluid with an ultra-high pressure to flow to the pressure transfer tool.

In accordance with an embodiment of the present invention, the apparatus further comprises an attenuator connected with a passageway of the pressure intensifier pump. Herein, the attenuator is configured to diminish effect of any significant drop in the pressure of the ultra-high pressure closed loop fluid by limiting the drop in ultra-high pressure discharge pressure. Additionally, the attenuator adapted to maintain ultra-high-pressure flow of closed loop hydraulic fluid during a non-pumping period at an end of a stroke when the pressure intensifier pump shifts direction and provide a constant ultra-high-pressure flow.

In accordance with an embodiment of the present invention, the pressure transfer tool comprises one or more piston assemblies, including respective pistons, corrosion resistance plungers, control valves and trigger valves. Herein, the respective pistons are reciprocated by using control valve and trigger valve using the ultra-high pressure of the closed loop hydraulic fluid. In addition, the reciprocating motion of the one or more piston assemblies are adapted to cause the respective plungers to reciprocate sequentially on an intake stroke to draw-in the drilling fluid; transfer the ultra-high pressure of the closed loop fluid to the drilling fluid; and supply the drilling fluid with the ultra-high pressures to the drill bit during a discharge stroke.

According to another embodiment of the present invention, there is provided an apparatus for generating an ultra-high pressure fluid jet during drilling. The apparatus comprises a drilling motor to enable rotation of the apparatus; and a housing structure having a longitudinal string axis, an upstream end connected with the drilling motor adapted to receive a drilling fluid therefrom and a downstream end; and a drill bit assembly connected at the downstream end of the housing structure, the drill bit assembly having a high-pressure fluid jet discharge means. Herein, the housing structure comprises an oscillation tool configured to transfer a pressure energy from the received drilling fluid to a closed loop hydraulic circuit and pressurize the closed loop hydraulic fluid circulating therein; a pressure intensifier pump connected downstream of the oscillation tool, configured to receive the closed loop hydraulic fluid from the oscillation tool which is adapted to reciprocate piston assembly using trigger and control valves and meanwhile receive the drilling fluid in a corrosion-resistant plunger chamber area of the pressure intensifier pump where the hydraulic pressure of drilling fluid is increased to an ultra-high pressure; and a pressurized hydraulic fluid reservoir, configured to compensate if there is any oil leak in the apparatus. Further, the housing structure having the oscillation tool and the intensifier pump connect directly to the bit through a special conduit and the ultra-high pressure of drilling fluid is directed to the discharge means in the drill bit assembly to aid drilling efficiency in drilling applications.

BRIEF DESCRIPTION OF THE DRAWING

These and other features, aspects, and advantages of the example embodiments will become better understood when the following detailed description is read with reference to the accompanying drawings in which like characters represent like parts throughout the drawings, wherein.

Figure 1A:
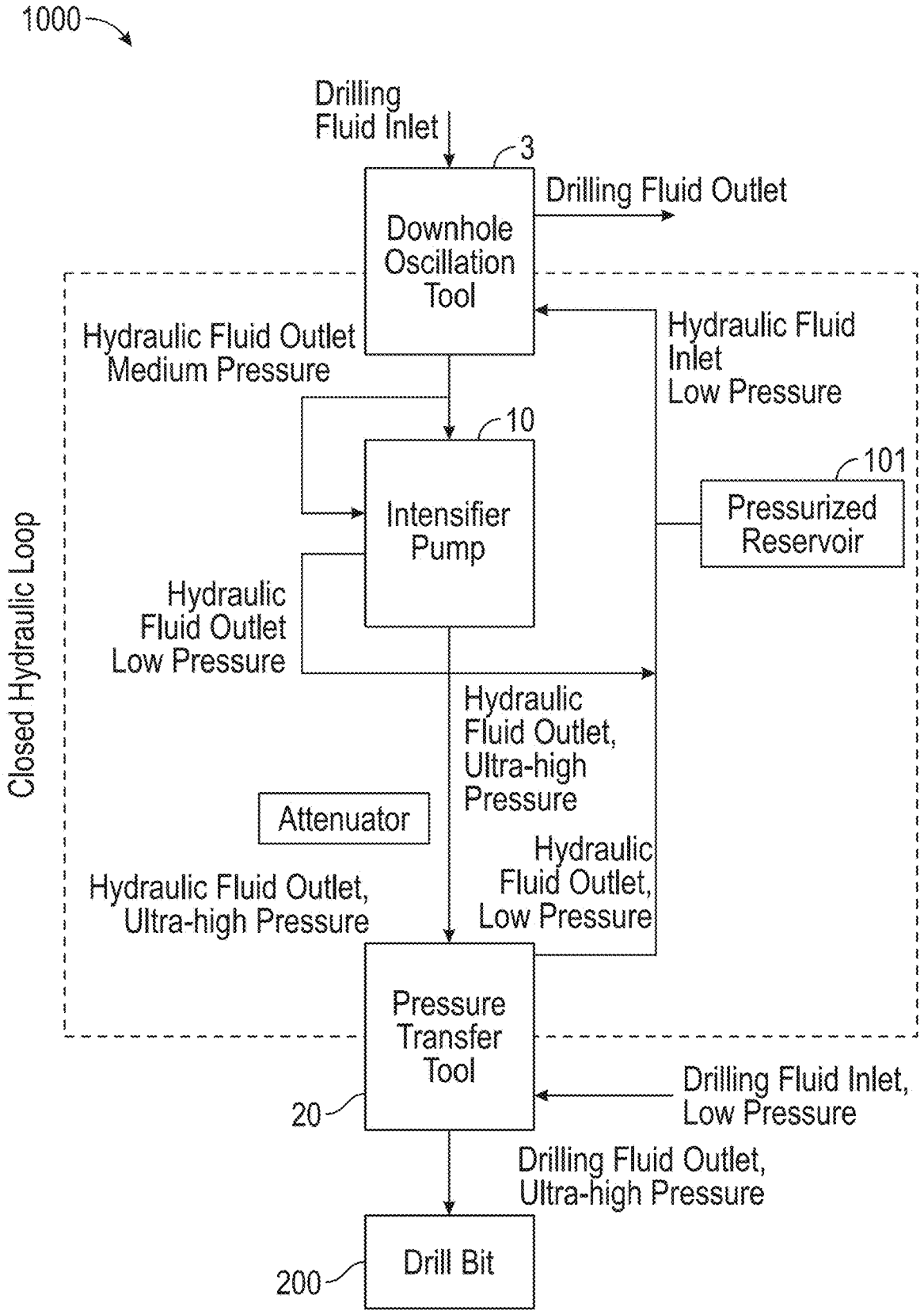
FIG. 1A shows an overview schematic of an apparatus for generating an ultra-high pressure fluid jet during drilling in a form of block diagram, in accordance with an embodiment of the present invention.

Further, skilled artisans will appreciate that elements in the figures are illustrated for simplicity and may not have necessarily been drawn to scale. Furthermore, in terms of the construction of the apparatus, one or more components of the apparatus may have been represented in the figures by conventional symbols, and the figures may show only those specific details that are pertinent to understanding the preferred embodiment of the present invention so as not to obscure the figures with details that will be readily apparent to those of ordinary skill in the art having the benefit of the description herein.

DETAILED DESCRIPTION OF THE DRAWINGS

While the present invention is described herein by way of example using embodiments, those skilled in the art will recognize that the invention is not limited to the embodiments described herein. It should be understood that the description herein is not intended to limit the invention to the particular form disclosed, but on the contrary, the invention is to cover all modification/s, equivalent/s and alternative/s falling within the scope of the present invention. The headings used herein are for organizational purposes only and are not meant to be used to limit the scope of the description or the claim. As used throughout this description, the word "may" be used in a permissive sense (i.e., meaning having the potential to), rather than the mandatory sense (i.e., meaning must). Further, the words "a" or "an" means "at least one" unless otherwise mentioned. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the likes are included in the specification solely for the purpose of providing a context for the present invention. It is not suggested or represented that any or all these matters form part of the prior art base or were common general knowledge in the field relevant to the present invention.

In this disclosure, whenever an element or a group of elements is preceded with the transitional phrase "comprising", it is understood that we also contemplate the same composition, element or group of elements with transitional phrases "consisting of", "consisting", "selected from the group of consisting of", "including", or "is" preceding the recitation of the composition, element or group of elements and vice versa.

This invention described herein may be embodied in many different forms and should not be construed as limited to the embodiment set forth herein. Rather, the embodiments are provided so that this disclosure will be thorough and complete and will fully convey the scope of the invention to those skilled in the art. In the following description, numeric values and ranges are provided for various aspects of the implementations described. These values and ranges are to be treated as examples only and are not intended to limit the scope of the claims. In addition, a number of materials are identified as suitable for various facets of the implementations. These materials are to be treated as exemplary and are not intended to limit the scope of the invention.

In general, the embodiment of the present invention provides an apparatus for generating an ultra-high pressure fluid jet during drilling. Principally, the apparatus utilizes an oscillation tool which is operated by drilling fluid pumped inside drill pipe. Drilling fluid operates in the piston chamber, while a closed loop hydraulic fluid operates in the plunger chamber. The pressure generated by plunger is higher than drilling fluid pressure based on the ratio between piston and plunger diameter. The most important feature that there is no direct communication between drilling fluid and closed loop hydraulic fluid. The pressurized closed loop hydraulic fluid is then directed to intensifier pump and its path controlled by a control valve and trigger valve. The intensifier pump further increases the pressure of the closed loop hydraulic fluid to an ultra-high pressure based on ratio between piston and plunger area. Then, ultra-high pressure of closed in hydraulic fluid directed to pressure transfer tool which transfers the pressure energy from the closed loop hydraulic fluid to the drilling fluid, while the released closed loop hydraulic fluid from intensifier pump and pressure transfer tool returns to pressurized fluid reservoir and then to the oscillation tool to repeat same cycle, thus working in a closed loop. Now, the ultra-high pressure drilling fluid is directed to the drill bit and exit to drilled hole. The exit is located to the closest point to drilled formation to increase drilling efficiency. Also, there is an ultra-high-pressure attenuator 8 which maintains ultra-high-pressure flow of closed loop hydraulic fluid during the non-pumping period at end of stroke when intensifier pump shifts direction and provides a more constant ultra-high-pressure flow. In this manner, the closed loop hydraulic fluid circuit allows the apparatus to overcome the problems of prior art and prevents any entry of drilling fluid within the intensifier pumps, thereby posing no harm to the intensifier pump or preventing potential pumps failures and further improving the drilling efficiency.

The present invention will now be explained in detail with reference to the accompanying drawings.

Figure 1B:
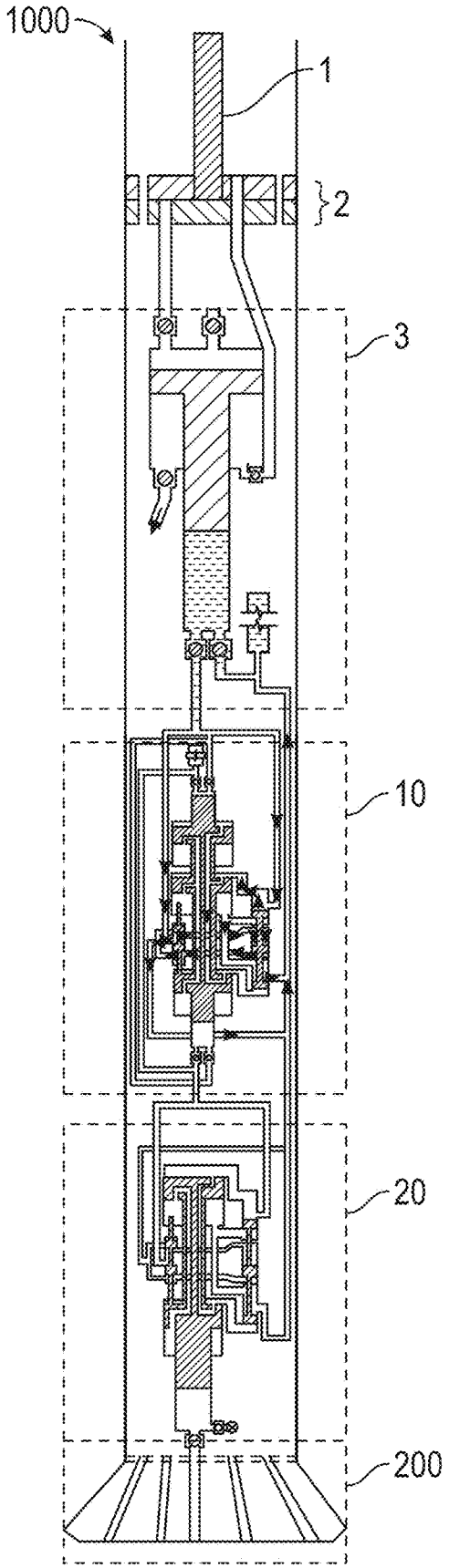
FIG. 1B shows the apparatus for generating an ultra-high pressure fluid jet during drilling in a sectional side view, in accordance with a preferred embodiment of the present invention.

FIGS. 1A-1B is a schematic showing an apparatus 1000 for generating an ultra-high pressure fluid jet during drilling (hereinafter referred to as "the apparatus 1000"), in accordance with an embodiment of the present invention. The drilling applications may include, but not limited to, drilling of boreholes, perforations, fracing, stimulating oil and gas wells, and drilling underground tunnels. These figures clearly illustrate all the components of the apparatus 1000 and a unique closed loop layout disposed therebetween for hydraulic fluid.

Herein, FIG. 1A shows an overview schematic of an apparatus 1000 in a form of block diagram and FIG. 1B shows the apparatus 1000 in a sectional side view, in accordance with an embodiment of the present invention. The apparatus 1000 comprises, but not limited to, a drilling motor to enable rotation of the apparatus 1000; a housing structure having a longitudinal string axis, an upstream end connected with the drilling motor adapted to receive a drilling fluid therefrom and a downstream end; and a drill bit assembly connected at the downstream end of the housing structure, the drill bit assembly having a high-pressure fluid jet discharge means. As shown in FIG. 1A-1B, the housing structure includes an oscillation tool, a pressure intensifier pump, a pressure transfer tool and a hydraulic fluid reservoir. Each of the components will now be described in detail using the reference drawings.

Figure 2A:
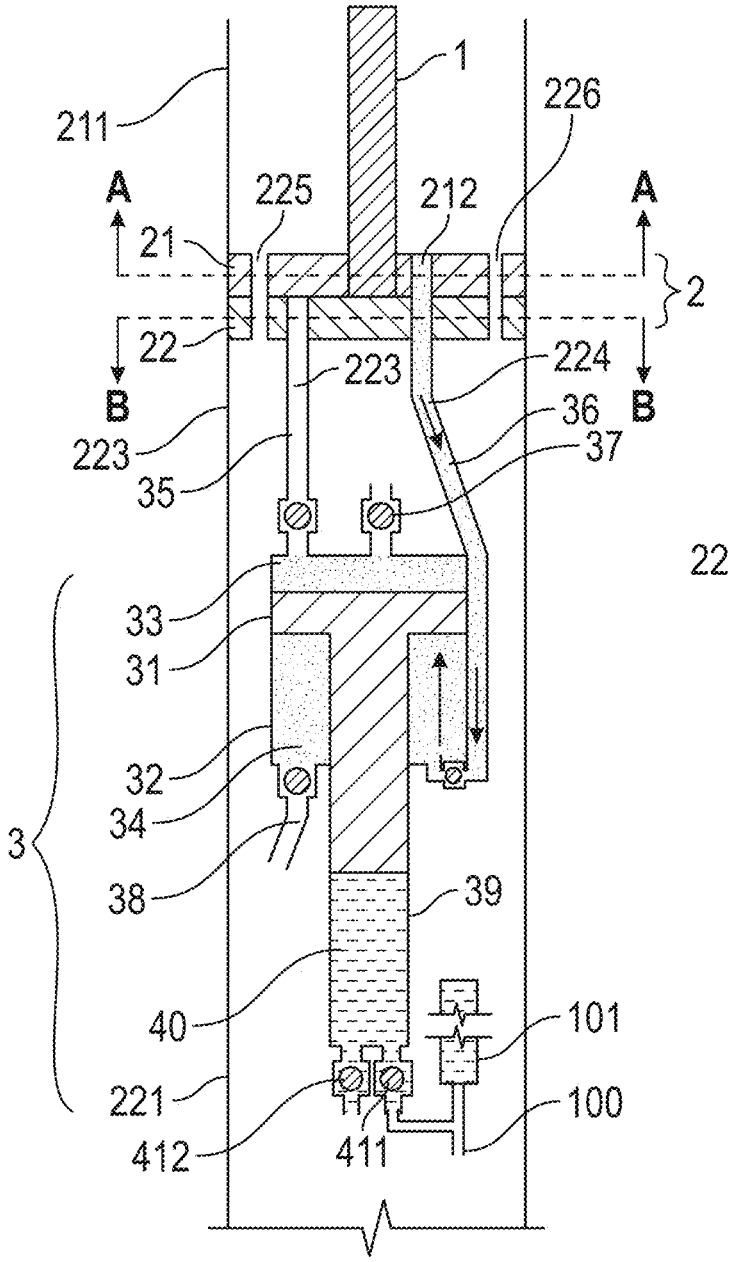
FIG. 2A shows a schematic diagram of a downhole oscillation tool of the apparatus of FIGS. 1A and 1B, in a first position, in accordance with a preferred embodiment of the present invention.

FIG. 2A shows a schematic diagram of a downhole oscillation tool 3 of the apparatus 1000 of FIGS. 1A and 1B, in a first position, in accordance with an embodiment of the present invention. The downhole oscillation tool 3 is configured to transfer a pressure energy from the received drilling fluid to a closed loop hydraulic circuit and pressurize the closed loop hydraulic fluid circulating therein referring the drawings, FIG. 2A illustrates cross-section of a mud motor drive shaft 1, a valve plate 2 and a downhole oscillation tool 3. In this embodiment, a positive displacement motor rotates as drilling fluid is pumped through the drilling motor. The valve plate assembly 2 includes a stationary valve plate 21 which is fixedly coupled to the upper outer housing 211 and rotating valve plate 22 which is mounted and connected in the lower end of the motor drive shaft 1 and it rotates with it. The same have been illustrated individually in FIGS. 2B and 2C respectively.

In one embodiment, the motor drive shaft 1 rotates the complete downhole apparatus 1000 including lower outer housing 221. In another embodiment, the drive shaft 1 rotates the complete downhole apparatus 1000 which forms an inner housing, meanwhile the lower outer housing 221 is connected with the upper housing 211. The inner and outer housing may be separated by bearings and in between there are drilling fluid circulation paths. In both configurations, motor rotation is designed to reach drilling bit 200 and hence the benefit of motor rotation is not lost.

Figure 2B:
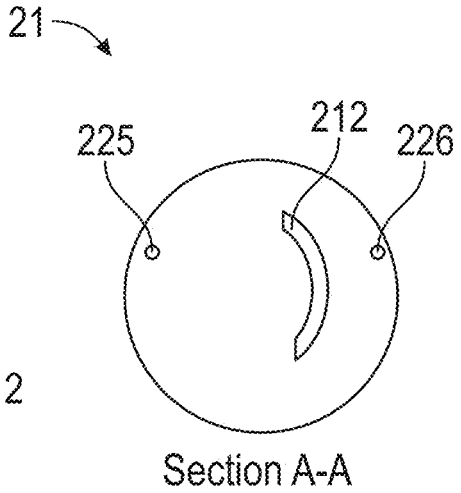
FIG. 2B shows a top view of a stationery valve plate marked by section A-A in the downhole oscillation tool of FIG. 2A, in accordance with a preferred embodiment of the present invention.
Figure 2C:
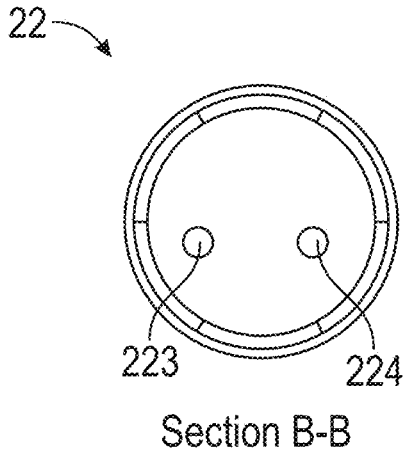
FIG. 2C shows a bottom view of a rotating valve plate marked by section B-B in the downhole oscillation tool of FIG. 2A, in accordance with a preferred embodiment of the present invention.

As shown in FIG. 2C, the rotating valve plate 22 has two ports, a power port 223 and a return port 224. Further referring to FIG. 2B, the stationary valve plate 21 has C-port 212 which has an alignment with power port 223 and return port 224. In addition, the stationary valve plate 21 has other ports for drilling fluid circulation paths (225 and 226 or more) which are not aligned with return port 224 and power port 223, and are used to cool downhole assemblies. These ports 225 and 226 are designed to allow the drilling fluid to pass through and provide passage between the inner housing and outer housing 221.

Referring back to 2A, it can be observed that as the motor drive shaft 1 rotates, the rotating valve plate 22 including the power port 223 and the return port 224 rotates and would intermittently overlap with C-port 212 in the stationary valve plate 21 and hence create a communication path which provides a communication of the drilling fluid with an oscillation tool piston 31.

As illustrated in FIG. 2A-2B, the oscillation tool piston 31 is accommodated in a cylinder 32 having an upper chamber 33 and a lower chamber 34. A power conduit 35 is provided to enable a fluid communication between the power port 223 and the upper chamber 33, while a return conduit 36 enables a fluid communication between the return port 224 and the lower chamber 34. An exhaust nozzle 37 is disposed for exhaust from the upper chamber 33 and an exhaust nozzle 38 is disposed for the exhaust from lower chamber 34.

Figure 2D:
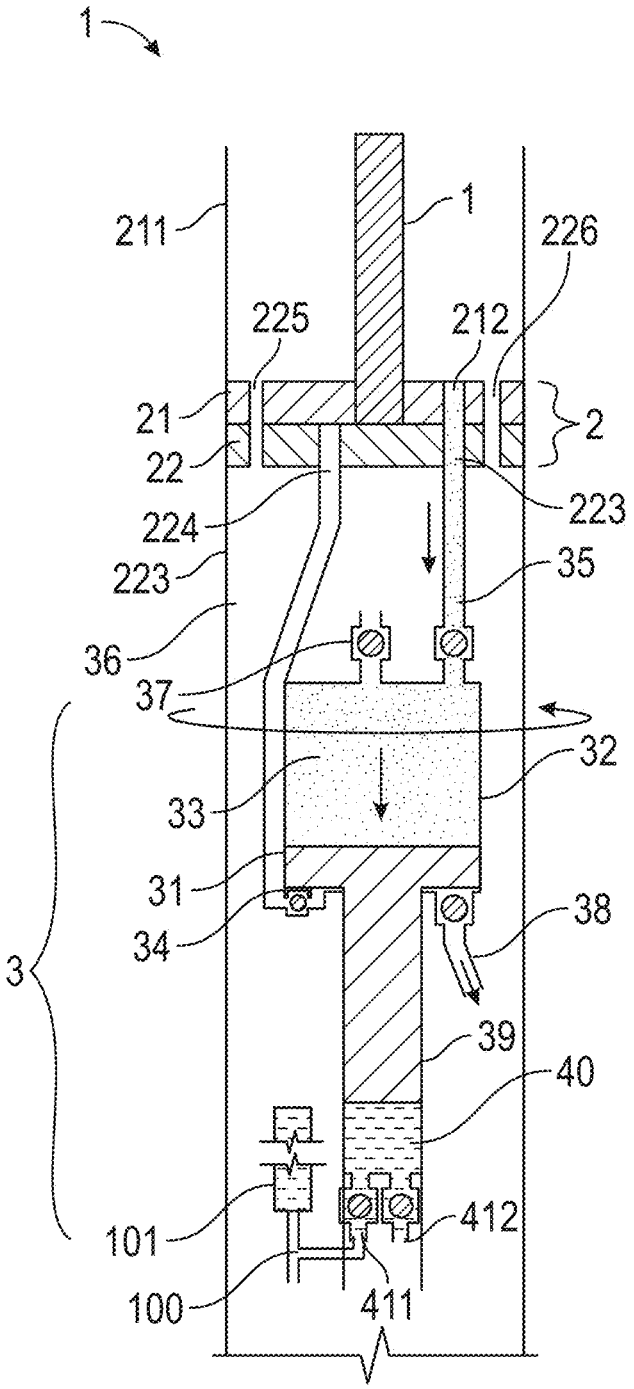
FIG. 2D shows a schematic diagram of a downhole oscillation tool of the apparatus of FIGS. 1A and 1B, in a second position, in accordance with a preferred embodiment of the present invention.

As noted above, a rotation of the rotating valve plate 22 causes it to overlap with C-port 212 in the stationary plate 21. During the alignment between C-port 212 and power port 223 in rotating plate 22, drilling fluid flows through power port 223 and the power conduit 35, into the upper piston chamber 33. The fluid pressure differential across the piston 31 pushes the piston 31, and thus plunger 39, downward such that plunger pressurizes a closed loop hydraulic fluid, as illustrated in FIG. 2D. The piston 31 has been pushed downward from a first position in FIG. 2A, to a second position in FIG. 2D. As the piston 31 moves down through the piston cylinder 32, the drilling fluid is displaced from the lower chamber 34 through the lower exhaust nozzle 38. As the motor rotor rotates, the alignment between ports alters to return port 224 and C-port 212. Hence, drilling fluid is then supplied, through the return port 224 and the return conduit 36, to the lower chamber 34. The pressure differential across the piston 31 forces the piston 31, and thus also the plunger 39, upwards, as is illustrated in FIG. 2A.

As the piston 31 moves upwards through the piston cylinder 32, the drilling fluid is displaced from the upper piston chamber 33 through the exhaust nozzle 37. Based on the piston 31 movements, the plunger 39 moves upwards and downwards accordingly. During plunger 39 downward movement, it pressurizes the closed loop hydraulic fluid and during plunger 39 upward movement, it brings in the closed loop hydraulic fluid to enter plunger cylinder 40. The plunger cylinder 40 has an inlet check valve 411 and an outlet check valve 412 to accomplish the proper inlet and outlet flows of the closed loop hydraulic fluid in the plunger cylinder 40. As mentioned before, there is no direct communication between the drilling fluid and the closed loop hydraulic fluid. The closed loop hydraulic fluid is then meant to be directed to the intensifier pump 10.

It will be appreciated by a person skilled in the art that the concept of this pressure transfer between the drilling fluid and the closed loop hydraulic fluid without any direct communication, is not limited to the preferred embodiment, and may be implemented by other methodologies as well, without departing from the scope of the present invention.

Figure 3A:
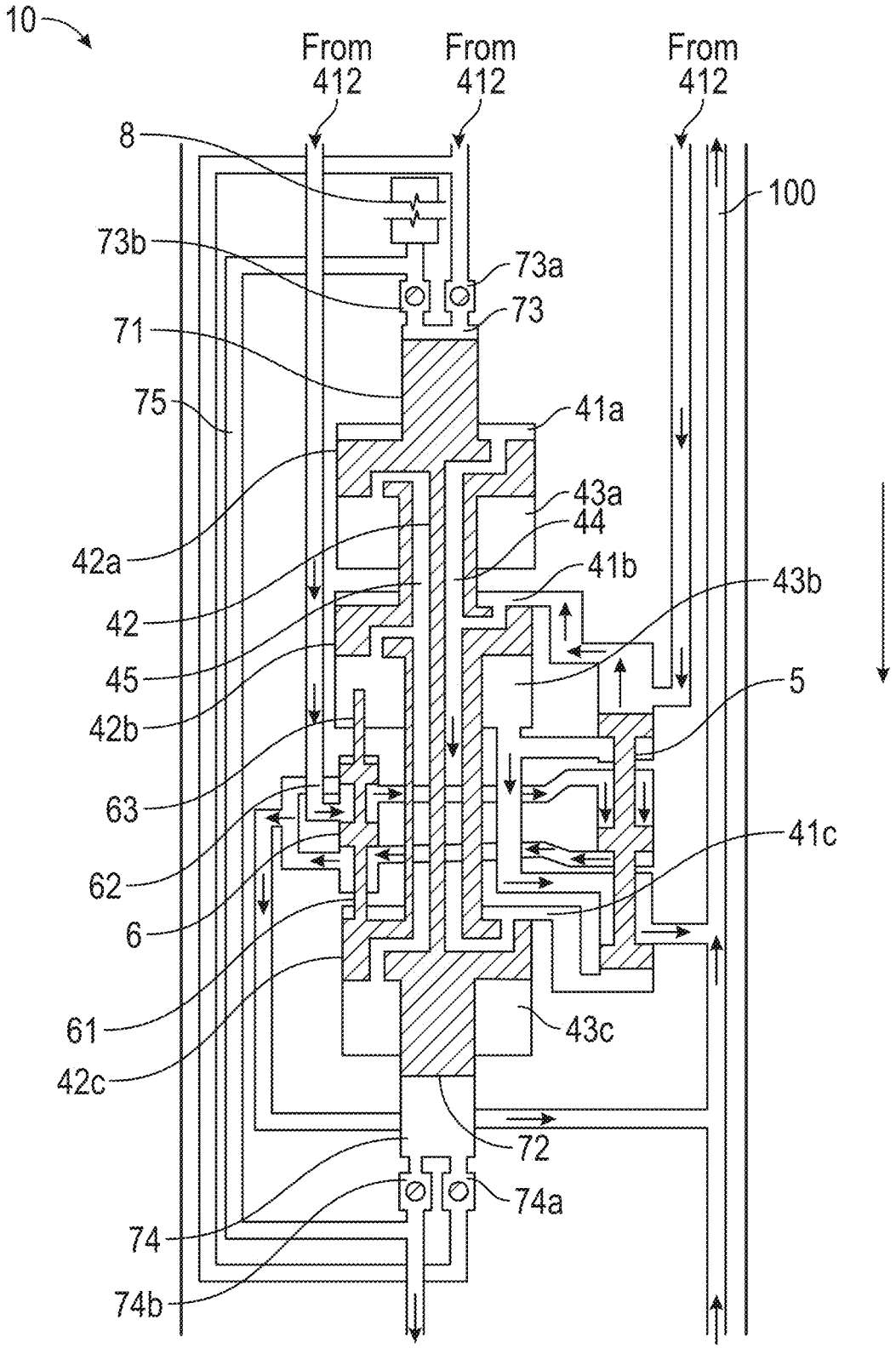
FIG. 3A-3D show a simplified schematic diagram of intensifier pump along with control valve and pilot valve set up, illustrating multiple positions of pistons and plungers, in accordance with a preferred embodiment of the present invention.

FIGS. 3A-3D show a simplified schematic diagram of intensifier pump along with control valve and pilot valve set up, illustrating multiple positions of pistons and plungers, in accordance with an embodiment of the present invention. Reference is now to FIG. 3A, it shows a cross section of the intensifier pump 10 along with trigger valve 6 and control valve 5. As discussed in the background section, the working principle of intensifier pump is known in the art, such as those disclosed in U.S. Pat. No. 5,787,998 in detail, however, their usage with drilling fluid hasn't got the commercial acceptance due to the no. of problems it has caused. Therefore, the present invention also aims to solve the said problems and find a novel way to utilize the intensifier pumps without facing any corrosion, abrasion or other issues due to drilling fluid.

However, for sake of understanding the present invention, the intensifier pump and its working is briefly explained here. So, the intensifier pump in general comprises, but not limited to, one or more piston assemblies including one or more intensifier pistons in respective piston 315 chambers, one or more intensifier plungers in respective plunger cylinders, control valve and trigger valve. It will be appreciated by a skilled addressee that although the embodiment shown in FIGS. 3A-3D show a limited no. of pistons, plungers, control/trigger valves etc., but the number can be increased or decreased as per the requirements of the application and the desired pressure requirements, without departing from the scope of the present invention.

Figure 3B:
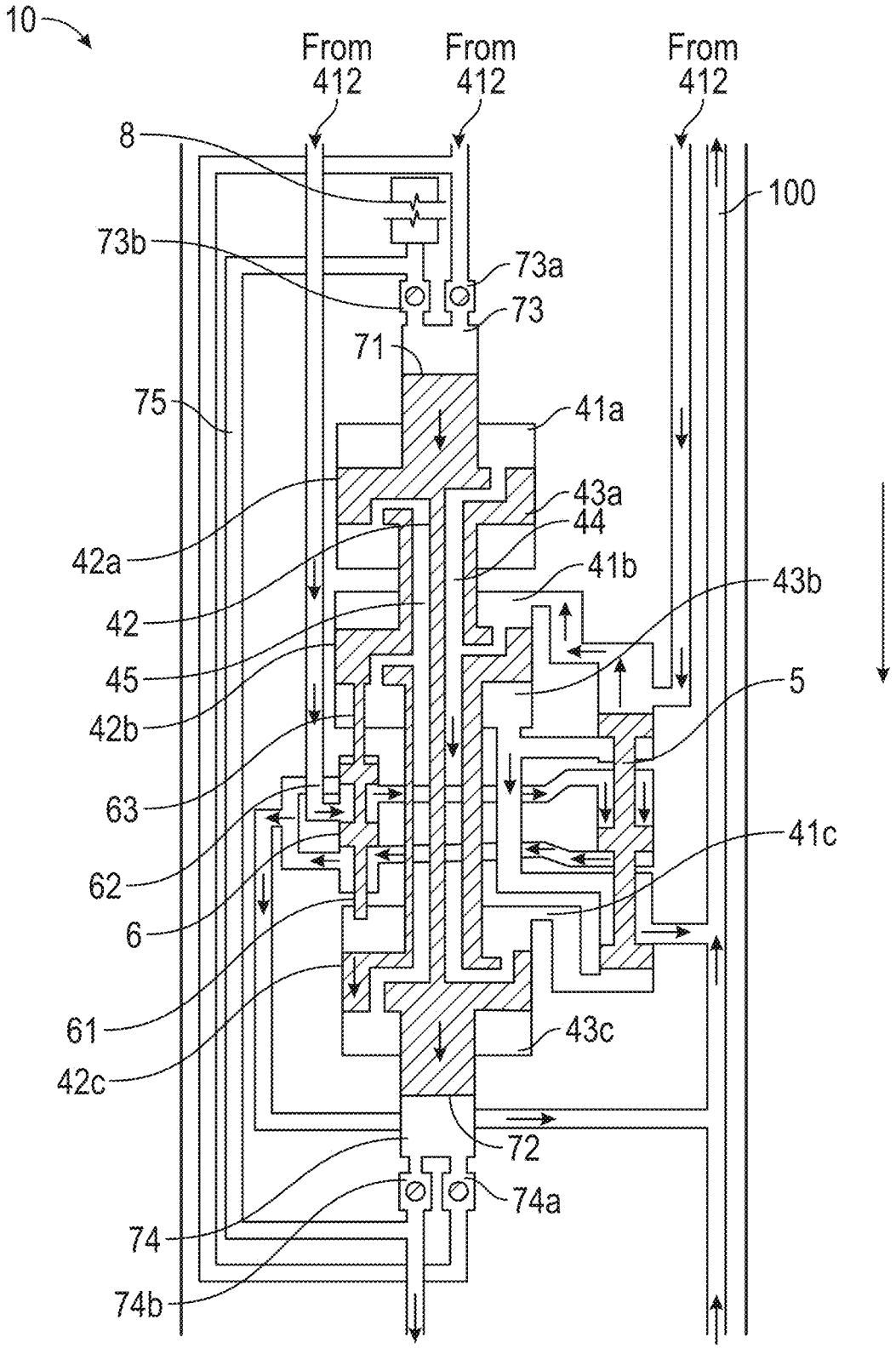
Figure 3C:
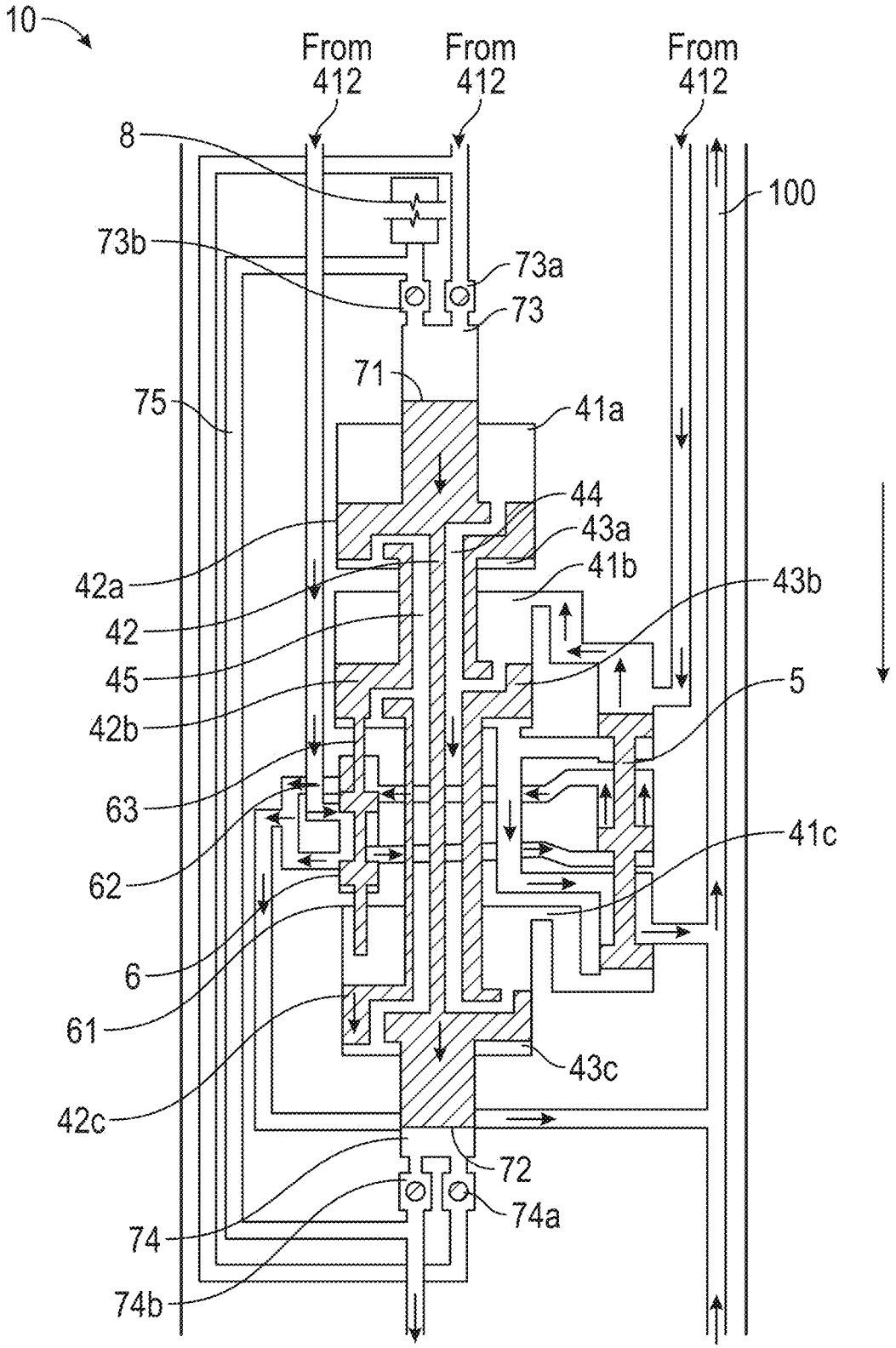
Figure 3D:
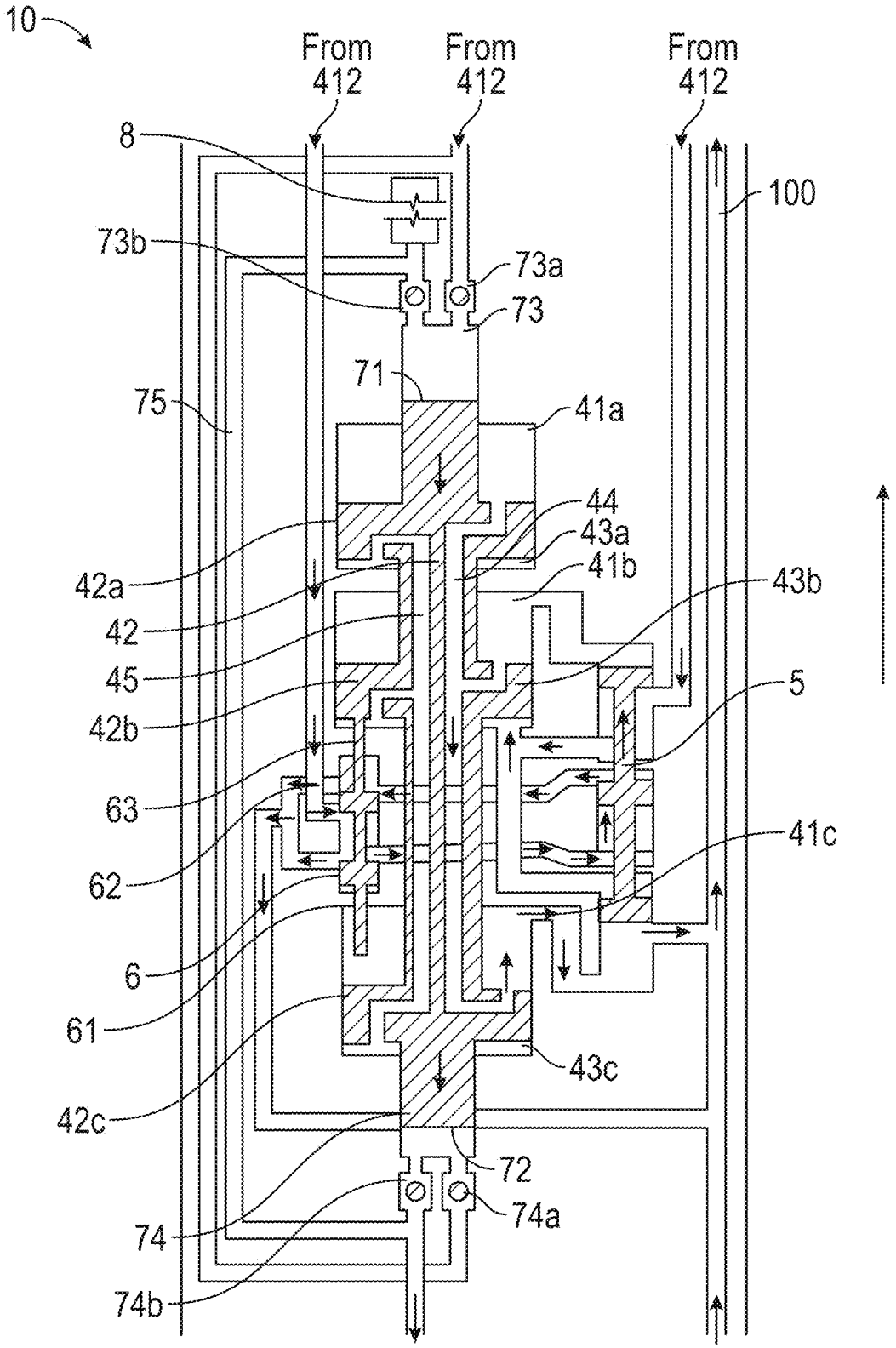

Coming back to the working, in the oscillation tool 3, the closed loop hydraulic fluid was pressurized (say, up to a medium pressure) and directed to the intensifier pump. The medium pressurized closed loop hydraulic fluid is directed to intensifier piston chambers 41*a/b/c* due to the action of the control valve 5 to cause the piston assembly 42 to reciprocate downward as illustrated in FIG. 3A. FIGS. 3B-3C show different positions of piston & plunger during downward movement. Further, when the piston assembly 42 has just completed its travel to downward (bottom-most position) as shown in FIGS. 3C, the upper trigger valve finger 63 of the trigger valve 6 is engaged by the piston 42*b*, and this moves the trigger valve element 6. This causes the trigger valve inlet port 62 to communicate and directs the closed loop hydraulic fluid toward control valve 5. This in turn causes the control valve element 5 to move to other direction (upward) as shown in FIG. 3D. The change in the position of the control valve causes the closed loop hydraulic fluid to change its flow path towards the piston chambers 43*a/b/c*. Hence the piston assembly 42 would beginning to travel to other upward direction.

Again, when the piston assembly 42 reach to the end on upward travel (like the one shown in figure-3A), the bottom finger 61 of the trigger valve 6 engaged by piston 42*c*. So, this moves the trigger valve element 6 back to its previous position in FIG. 3A. Accordingly, this causes the trigger valve inlet port 62 to communicate and directs the closed loop hydraulic fluid toward other chamber in control valve 5 again, which in turn causes the control valve element 5 to move to its previous position. The change in control valve's 5 positions (FIGS. 3A & 3D) causes the closed loop hydraulic fluid to change its flow path again toward piston chambers 41*a/b/c* and repeat the same, as explained when piston assembly 42 reached to the end on downward travel.

This reciprocating motion of the piston assembly 42, causes each of the plungers 71 and 72 to reciprocate sequentially on an intake stroke and discharge stroke to supply the closed loop hydraulic fluid with an ultra-high pressure to flow to the pressure transfer tool-C. The chamber portions 41*a*, 41*b* and 41*c*, are interconnected with one another through a central passageway 44. Same for the chamber portions 43*a*, 43*b* and 43*c* are interconnected with one another through a central passageway 45. Thus, it can be recognized that when the closed loop hydraulic fluid passes to the chamber portion 43*b*, it also flows into chamber portion 43*a* and 43*c*, through the passageway 45. Similarly, when the closed loop hydraulic fluid passes to the chamber portion 41*b*, it also flows into the port 41*a* and 41*c* through the passageway 44. The return of closed loop hydraulic fluid from trigger valve 6 and control valve 5 are directed to the pressurized reservoir 101 via passageway 100 to repeat same cycle.

The outlet pressure from intensifier plunger 72 is based on a ratio between piston and plunger area (for example, if a ratio is around 14 and then, the pressure could reach to 60,000 Psi). Another factor to have more outlet pressure from the intensifier pump 10 is to increase the no. of pistons to increase the total force exerted on the piston assembly 72, and hence cause a substantial force on plungers 71 and 72 so that more pressure can be generated. In accordance with an embodiment of the present invention shown in FIG. 3A-3D, the two ultra-high-pressure cylinders 73 & 74 are each provided with inlet check valves (73*a* and 74*a*) and outlet check valves 73*b* and 74*b* to accomplish the proper inlet and outlet flows of closed loop hydraulic fluid in each ultra-high-pressure cylinder 73 & 74.

The preferred embodiment has three pistons to increase the total force exerted on the piston assembly 72, without increasing the diameter of the pistons (42*a*, 42*b* and 42*c*) and hence cause a substantial force on plungers 71 and 72 so that more pressure can be generated. The alternative embodiments have more or less no of pistons to have more or less pressures based on applications, without departing from the scope of the present invention.

Referring to FIGS. 3A-3D, the two outlet check valves 73*b* and 74*b* are interconnected with one another through the passageway 75 and this passageway 75, that also connects to the attenuator 8. With the rapid transition in the trigger valve 6 and the control valve 5, the reversal of flow in the chambers 73 and 72 is very rapid, and hence the attenuator 8 diminishes the effect of any significant drop in the pressure in the ultra-high pressurized closed loop hydraulic fluid by limiting the drop in ultra-high discharge pressure.

Then, the ultra-high pressure of closed loop hydraulic fluid moves to the pressure transfer energy tool 20 which is configured to transfer ultra-high pressure from the closed loop hydraulic fluid to the drilling fluid.

Figure 4A:
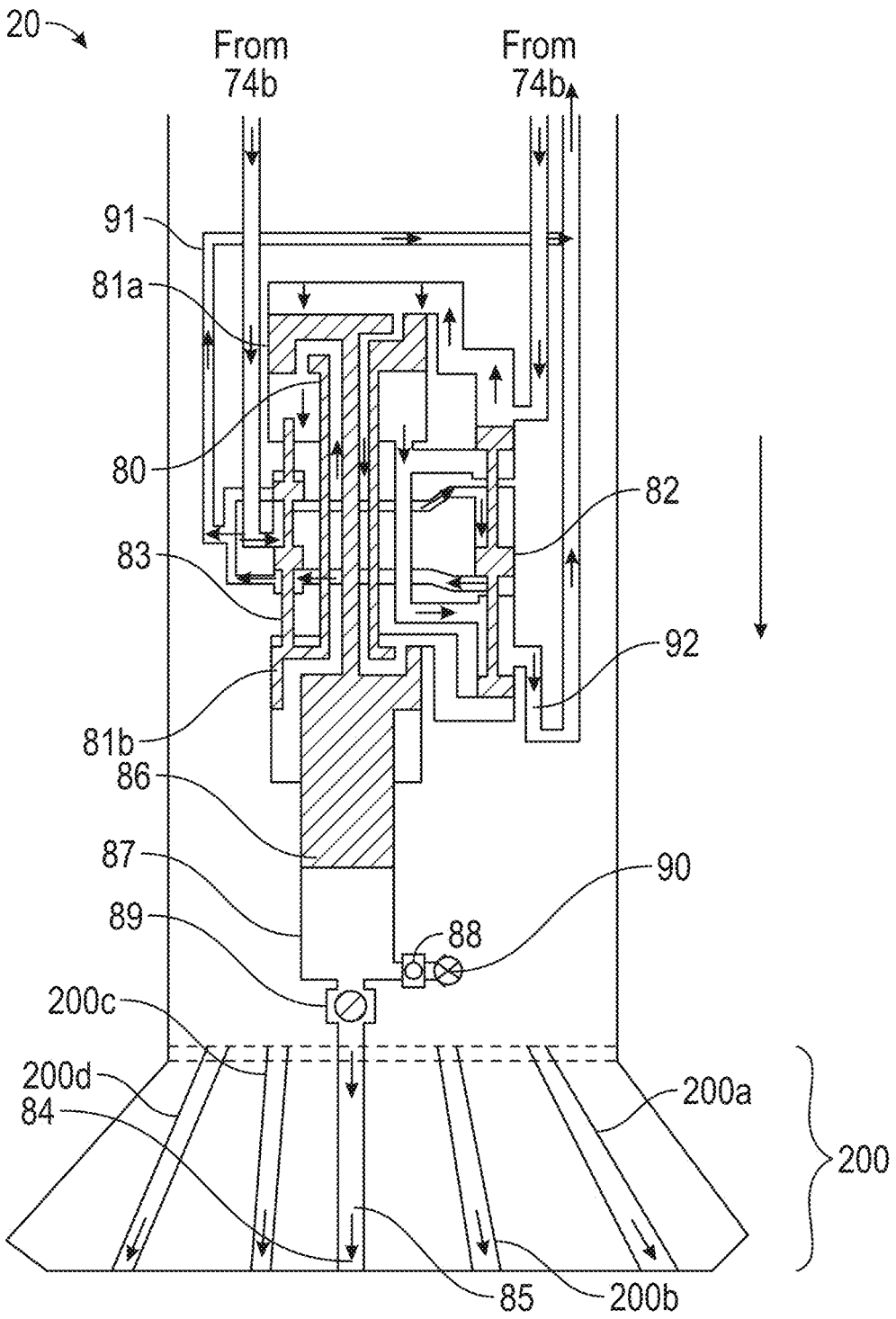
FIG. 4A-4B show a pressure transfer tool and flow circuit details of closed loop hydraulic fluid and drilling fluid, in accordance with a preferred embodiment of the present invention.
Figure 4B:
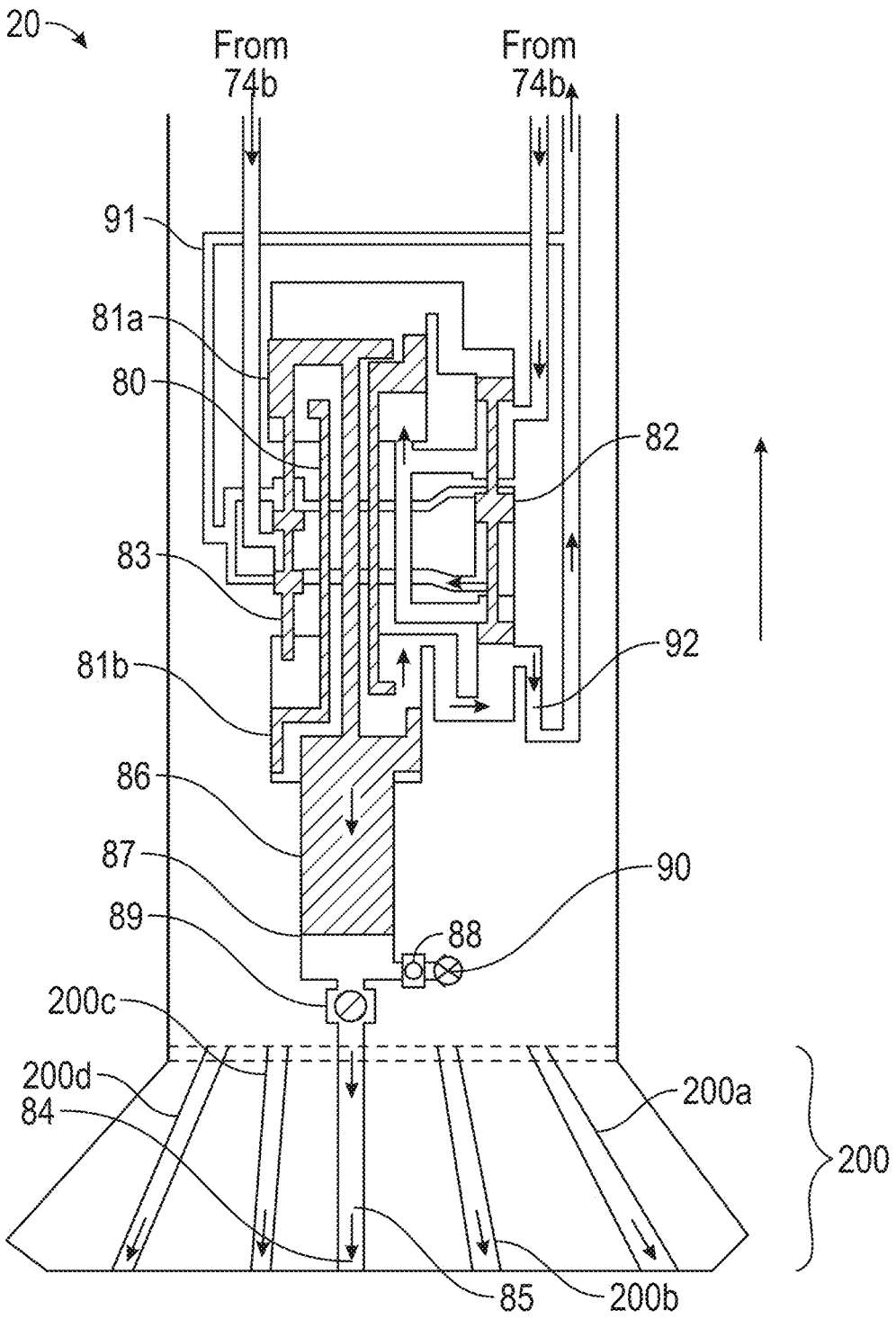

FIG. 4A-4B illustrates a pressure transfer tool 20 and flow circuit details of closed loop hydraulic fluid and the drilling fluid, in accordance with an embodiment of the present invention. FIGS. 4A-4B show a cross sectional view of the pressure transfer tool 20 which comprises with pistons 81*a* and 81*b* and large diameter plunger 86. Similar to the working principle of the intensifier pump 10, the pistons 81*a* and 81*b* are reciprocated by using control valve 82 and trigger valve 83, but here, it is facilitated by using the ultra-high pressure of the closed loop hydraulic fluid. The reciprocating motion of the piston assembly 81*a* and 81*b*, causes the plunger 86 to reciprocate sequentially on an intake stroke and discharge stroke to transfer the ultra-high pressure of the closed loop hydraulic fluid to the drilling fluid and then supply the drilling fluid with the ultra-high pressures to bit nozzle 84 through special conduit 85. The diameter of plunger 86 in this embodiment is close to pistons' diameter 81*a* and 81*b* since the objective in this tool to transfer the ultra-high-pressure energy, more than to generate higher pressure.

Again, just like the intensifier pumps, the other embodiments of the pressure transfer tool 20 could have more than two pistons to increase the total force exerted on the plunger 86 so that more pressure is generated, with departing from the scope of the present invention. Further, the ultra-high-pressure plunger cylinders 87 has an inlet check valve 88 and an outlet check valve 89 to accomplish the proper inlet and outlet flows of drilling fluid in the ultra-high-pressure cylinder 87. To reduce of drilling fluid effect, one embodiment has filter 90 ahead of inlet check valve 88 to reduce drilling fluid particles. In addition, the ultra-high pressure plunger cylinder 87 has protection against drilling fluid abrasiveness and erosion. The preferred embodiment has diaphragm cylinder to avoid any drilling erosion and fluid abrasiveness. In another embodiment, similar approach of a scalation tool 3 could be used to transfer hydraulic pressure from closed loop hydraulic fluid to the drilling fluid.

The outlet of the pressure transfer tool 20 directs the ultra-high pressure drilling fluid directly to nozzle bit 84 via special conduit 85. The nozzle bit 84 could be more than one nozzle to maximize the benefit of the ultra-high pressure drilling fluid and accordingly, enhance the drilling rate of penetration. In other embodiments, to add more benefits, no. of intensifier pumps 10 or pressure transfer tools 20 may be added in the apparatus 1000 to increase the ultra-high pressure being delivered to bit nozzle 84, thereby enhancing the drilling rate of penetration further. Besides, the closed loop hydraulic fluid from the pressure transfer tool 20 due to the movement of the trigger valve 83 and the control valve 82, move back, via passageways 91 and 92 moves back to the oscillation tool to repeat same cycle through the passageway 100 and this passageway 100 also connects to the pressurized fluid reservoir 101. The pressurized hydraulic fluid reservoir is configured to compensate if there is any oil leak in the apparatus 1000.

According to another aspect of the present invention, in an alternative embodiment, the apparatus 1000 includes an oscillation tool 3 and intensifier pump 10 which connects directly to bit nozzle 84 through special conduit 85 of the drill bit assembly and the ultra-high pressure of drilling fluid is directed to the discharge means in the drill bit assembly to aid drilling efficiency in drilling applications. Most of the components remain the same as in previous embodiment, however, the main difference in this embodiment is that there is no requirement for energy transfer tool 20, since large diameter plunger featured in intensifier pump along with ultra-high pressure plunger chambers are designed to deal with the corrosive drilling fluid and are able to provide higher flow rate output. In operation, the pressure intensifier pump connected downstream of the oscillation tool, is configured to receive the closed loop hydraulic fluid from the oscillation tool which used to reciprocate piston assembly using trigger and control valves meanwhile receive the drilling fluid in a corrosion-resistant plunger chamber area of pressure intensifier pump and increase the hydraulic pressure of drilling fluid to an ultra-high pressure. To enable generating the required ultra-high pressure in the drilling fluid, the no. of pistons in the pressure intensifier pump is more to increase the total force exerted on the piston rod assembly to cause a substantial force on plunger so that having more generated pressure. This assembly set has relief valve to release any high pressure beyond the pressure limitation of the apparatus 1000.

In this manner, the introduction of the closed loop fluid circuit to the apparatus helps to overcome the problems of prior art. It allows the closed loop hydraulic fluid to operate in a closed loop between the oscillation tool, the pressure intensifier pump and the pressure transfer tool without any direct contact with the drilling fluid. This in turn prevents any entry of drilling fluid within the intensifier pumps, thereby posing no harm to the intensifier pump or preventing potential pumps failures. Additionally, it is configured in a way the main objective on providing more and higher bit rotation than drill string is not lost. The present invention can be used for other downhole applications as perforation, fracing and stimulating oil and gas wells or used in drilling underground tunnel or other application having similar problems.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing the broadest scope, consistent with the principles and the novel and inventive features disclosed or suggested herein. Accordingly, the invention is anticipated to hold on to all other such alternatives, modifications, and variations that fall within the scope of the present invention and the appended claims.

The invention claimed is:

1. An apparatus for generating a high pressure fluid jet during drilling, the apparatus comprising:

a drilling motor configured to enable rotation of the apparatus;

a housing structure comprising:

a longitudinal string axis;

an upstream end connected with the drilling motor adapted to receive a drilling fluid therefrom; and a downstream end;

a drill bit assembly connected at the downstream end of the housing structure, the drill bit assembly having a high-pressure fluid jet discharger; and wherein the housing structure comprises:

I. an oscillation tool configured to transfer a pressure energy from the received drilling fluid to a closed loop hydraulic circuit and pressurize the closed loop hydraulic fluid circulating therein;

II. a pressure intensifier pump connected downstream of the oscillation tool, configured to increase hydraulic pressure of the closed loop hydraulic fluid to a high pressure; and III. a pressure transfer tool connected downstream of the pressure intensifier pump, configured to transfer the high pressure from the closed loop hydraulic fluid to low-pressure drilling fluid, thereby increasing the low-pressure drilling fluid to high pressure drilling fluid, without any communication between the drilling fluid and closed loop hydraulic fluid and without requiring the drilling fluid to enter the pressure intensifier pump;

IV. a hydraulic fluid reservoir, configured to compensate if there is any oil leak in the apparatus;

wherein the closed loop hydraulic fluid operates in a closed loop between the oscillation tool, the pressure intensifier pump and the pressure transfer tool without any direct contact with the drilling fluid, and wherein the high pressure drilling fluid is directed to the discharger in the drill bit assembly to aid drilling efficiency in drilling applications, and wherein the pressure transfer tool comprises one or more piston assemblies, including respective pistons, corrosion resistance plungers, control valves and trigger valves.

2. The apparatus as claimed in claim 1, wherein the drilling applications include drilling of boreholes, perforations, fracking, stimulating oil and gas wells and drilling underground tunnels.

3. The apparatus as claimed in claim 1, further comprising one or more of drilling fluid circulation paths, and control valves and trigger valves to facilitate the flow of the closed loop hydraulic fluid within the apparatus.

4. The apparatus as claimed in claim 1, wherein the oscillation tool is connected with a motor drive shaft and a valve plate assembly, wherein the valve plate assembly includes a stationary valve plate fixedly coupled to an upper outer housing and a rotating valve plate mounted and connected with a lower end of the motor drive shaft and rotates with the motor drive shaft, and wherein the motor drive shaft is configured to rotate the complete downhole apparatus including lower outer housing, or the complete downhole apparatus excluding the lower outer housing, or in case the upper and lower housing are connected together, then the rotation is inside the housing only.

5. The apparatus as claimed in claim 4, wherein the oscillation tool comprises:

a piston and a plunger disposed in a cylinder having an upper chamber and a lower chamber;

a power conduit for enabling a fluid communication between a power port of the rotating valve plate and the upper chamber;

a return conduit for enabling a fluid communication between a return valve port of the rotating valve plate and the lower chamber; and an exhaust nozzle provided with the upper chamber and another exhaust nozzle provided with the lower chamber.

6. The apparatus as claimed in claim 5, wherein an upward movement of the piston is adapted to displace the drilling fluid from the upper piston chamber through the exhaust nozzle, wherein a downward movement of the piston is adapted to displace the drilling fluid from the lower piston chamber through another exhaust nozzle, wherein the plunger is adapted to move upward and downwards in the direction of piston movements, wherein the downward movement of the plunger is adapted to pressurize the closed loop hydraulic fluid to form a pressurized closed loop hydraulic fluid, and the upward movement of the plunger is adapted to draw the closed loop hydraulic fluid to enter the cylinder, and wherein the pressurized closed loop hydraulic fluid is directed to the pressure intensifier pump.

7. The apparatus as claimed in claim 1, wherein the pressure intensifier pump comprises one or more piston assemblies including one or more intensifier pistons in respective piston chambers, one or more intensifier plungers in respective plunger cylinders, control valve and trigger valve, and wherein the reciprocating motion of the piston assemblies is configured to cause each of the one or more plungers to reciprocate sequentially on an intake stroke, and a discharge stroke to supply the closed loop hydraulic fluid with a high pressure to flow to the pressure transfer tool.

8. The apparatus as claimed in claim 1, further comprising:

an attenuator connected with a passageway of the pressure intensifier pump, wherein the attenuator is configured to diminish effect of any significant drop in the pressure of the high pressure closed loop fluid by limiting the drop in high pressure discharge pressure, wherein the attenuator adapted to maintain high-pressure flow of closed loop hydraulic fluid during a non-pumping period at an end of a stroke when the pressure intensifier pump shifts direction and provide a constant high-pressure flow.

9. The apparatus as claimed in claim 1, wherein the respective pistons are reciprocated by using control valve and trigger valve using the high pressure of the closed loop hydraulic fluid, and wherein the reciprocating motion of the one or more piston assemblies are adapted to cause the respective plungers to:

reciprocate sequentially on an intake stroke to draw-in the drilling fluid;

transfer the high pressure of the closed loop fluid to the drilling fluid; and supply the drilling fluid with the high pressures to the drill bit during a discharge stroke.

10. An apparatus for generating an high pressure fluid jet during drilling, the apparatus comprising:

a drilling motor to enable rotation of the apparatus;

a housing structure comprising:

a longitudinal string axis;

an upstream end connected with the drilling motor adapted to receive a drilling fluid; and a downstream end, wherein the housing structure further comprising:

I. an oscillation tool configured to transfer a pressure energy from the received drilling fluid to a closed loop hydraulic circuit and pressurize the closed loop hydraulic fluid circulating therein;

II. a pressure intensifier pump connected downstream of the oscillation tool, configured to:

receive the closed loop hydraulic fluid from the oscillation tool which is adapted to reciprocate a piston assembly using trigger valves and control valves, and meanwhile receive the drilling fluid in a corrosion-resistant plunger chamber area of the pressure intensifier pump where the hydraulic pressure of drilling fluid is increased to an high pressure; and III. a hydraulic fluid reservoir, configured to compensate if there is any oil leak in the apparatus, and a drill bit assembly connected at the downstream end of the housing structure, the drill bit assembly having a high-pressure fluid jet discharger;

wherein the housing structure having the oscillation tool and the intensifier pump connect directly to the bit through a conduit and the high pressure of drilling fluid is directed to the discharger in the drill bit assembly to aid drilling efficiency in drilling applications, wherein the apparatus further comprises a pressure transfer tool connected downstream of the pressure intensifier pump, configured to transfer the high pressure from the closed loop hydraulic fluid to low-pressure drilling fluid, thereby increasing the low-pressure drilling fluid to high pressure drilling fluid, without any communication between the drilling fluid and closed loop hydraulic fluid and without requiring the drilling fluid to enter the pressure intensifier pump, and wherein the pressure transfer tool comprises one or more piston assemblies, including respective pistons, corrosion resistance plungers, control valves and trigger valves.

* * * * *